US005144383A

United States Patent [19]

Murano et al.

[11] Patent Number: 5,144,383

[45] Date of Patent: Sep. 1, 1992

[54] TRANSFER ASSEMBLY OF ELECTROPHOTOGRAPHIC PRINTER

[75] Inventors: Toshiro Murano; Masato Sakai, both of Tokyo, Japan

[73] Assignee: Oki Electric Industry Co., Ltd., Tokyo, Japan

[21] Appl. No.: 665,965

[22] Filed: Mar. 7, 1991

[30] Foreign Application Priority Data

Mar. 26, 1990 [JP] Japan ..... 2-29646

[51] Int. Cl.[5] ..... G03G 15/16

[52] U.S. Cl. ..... 355/274; 355/309

[58] Field of Search ..... 355/271, 274, 309; 361/214, 220

[56] References Cited

U.S. PATENT DOCUMENTS 3,924,943 12/1975 Fletcher ..... 355/274

4,055,380 10/1977 Borostyan ..... 355/274 X

FOREIGN PATENT DOCUMENTS 58-172668 10/1983 Japan ..... 355/274

62-124580 6/1987 Japan ..... 355/274

63-83741 4/1988 Japan ..... 355/274

*Primary Examiner*—Joan H. Pendegrass

*Attorney, Agent, or Firm*—Spencer, Frank & Schneider

[57] ABSTRACT

A transfer assembly of an electrophotographic printer includes a photoconductor drum, a charger disposed against the photoconductor drum for charging a surface of the photoconductor drum, an exposure unit for exposing the charged photoconductor drum to form an electrostatic latent image thereon, a developer unit disposed against the photoconductor drum for providing adhesion of a toner to the electrostatic latent image to form a toner image, a transfer unit disposed against the photoconductor drum for transferring the toner image to a medium, and a fuser for fixing the transferred toner image on the medium. In such an assembly, a part of the transfer unit, which first touches the medium to which the toner image has been transferred, is provided with a conductive material adapted to provide a gradual discharge of electric charge on the medium.

5 Claims, 3 Drawing Sheets

TRANSFER ASSEMBLY OF ELECTROPHOTOGRAPHIC PRINTER

BACKGROUND OF THE INVENTION

1. Field of the Invention

The present invention relates to a transfer assembly of an electrophotographic printer, and more particularly to a transfer assembly capable of avoiding variation in transfer efficiency, thereby maintaining stable printing quality.

2. Description of the Prior Art

Hitherto, in an electrophotographic printer, a charged photoconductor drum is illuminated with a light source to form an electrostatic latent image on a surface thereof, developing is performed upon adhesion of toner to the electrostatic latent image, and then the thus obtained toner image is transferred to a recording medium.

A transfer assembly of a conventional electrophotographic printer will be explained hereinafter. FIG. 3 shows a schematic representation of the transfer assembly of the conventional electrophotographic printer, and FIG. 4 shows a view for explanation of a transfer operation. In the FIGS., a transfer unit 10, which is made of metal, is disposed against a photoconductor drum 7, and is grounded to the frame of a power supply unit, not shown.

A recording medium 2 fed from a recording medium cassette is transmitted by a pressure roller 5*a* and a feed roller 5*b*, and reaches the photoconductor drum 7. An image has been formed on the surface of the photoconductor drum 7 with a toner charged with negative electricity (−). When the recording medium 2 arrives at the photoconductor drum 7, the transfer unit 10 produces the positive electric charge (+) as shown in FIG. 4 and transfers the image on the surface of the photoconductor drum 7 to the surface of the recording medium 2. The recording medium 2 to which the toner image is transferred is heated when passing through a heating roller 12*a* and a backup roller 12*b*. so that the toner is fused on the surface of recording medium 2.

During a process in which the recording medium 2 picked up from the recording medium cassette is transmitted through the pressure roller 5*a* and the feed roller 5*b*. and reaches the transfer unit 10. the recording medium 2 is charged with positive electricity (+). This positive electric charge (+) is utilized together with the positive electric charge (+) produced by the transfer unit 10 to transfer the image on the surface of the photoconductor drum 7 to the surface of the recording medium 2.

The electric charge stored in the recording medium 2 flows. when passing through the transfer unit 10. through a metallic frame of the transfer unit 10 into the power supply unit frame ground. and is grounded via a frame ground wire.

In the transfer assembly of the conventional electrophotographic printer as stated above. however. when the recording medium 2 touches the metallic frame of the transfer unit 10 until it reaches through between the pressure roller 5*a* and the feed roller 5*b*. the positive electric charge (+) on the recording medium 2 flows at once through the metallic frame of the transfer unit 10 to the power supply unit frame ground. and then is grounded via a frame ground line. Hence, variations of in transfer efficiency of the transfer assembly 10. are produced thereby decreasing a printing quality.

On the other hand, in order to prevent such a phenomenon, if there is provided an isolation member at a portion in the transfer unit 10, which portion the recording medium 2 touches so that electric charge is grounded, there is a disadvantage in that the positive electric charge is accumulated on the isolation member and invites adhesion of toner, thereby staining a back surface of the recording medium 2.

SUMMARY OF THE INVENTION

It is therefore an object of the present invention to provide a transfer assembly of an electrophotographic printer in accordance with which the foregoing problems have been solved. According to the present invention, it is possible to prevent the electric charge on the recording medium flowing at once directly to the metallic frame of the transfer assembly to thus avoid a variation of transfer efficiency, thereby maintaining stable printing quality.

Further it is an object of the present invention to provide a transfer assembly of an electrophotographic printer capable of preventing a back surface of the recording medium from being stained with toner.

In accordance with a preferred embodiment of the present invention, there is disclosed a transfer assembly of an electrophotographic printer comprising a photoconductor drum, charger means disposed against the photoconductor drum for charging a surface of said photoconductor drum, exposure means for exposing the charged photoconductor drum to form an electrostatic latent image thereon. developing means disposed against the photoconductor drum for providing adhesion of a toner to the electrostatic latent image to form a toner image, transfer means disposed against the photoconductor drum for transferring the toner image to a medium, and fuser means for fixing the transferred toner image on the medium, wherein a part of the transfer means, which first touches the medium to which the toner image has been transferred, is provided with a conductive material adapted to provide a gradual discharge of electric charge on the medium. In such a transfer assembly, a part of the transfer means, which first touches the medium transferred from a medium cassette through a pressure roller and a feed roller, is provided with a conductive material adapted to provide a gradual discharge of electric charge on the medium. Thus, the electric charge on the medium charged during transfer through the pressure roller and the feed roller will be gradually discharged by means of the conductive material. The toner image is transferred to the medium by means of the electric charge generated in the transfer means, in addition to the electric charge as stated above.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENT

Figure 2:
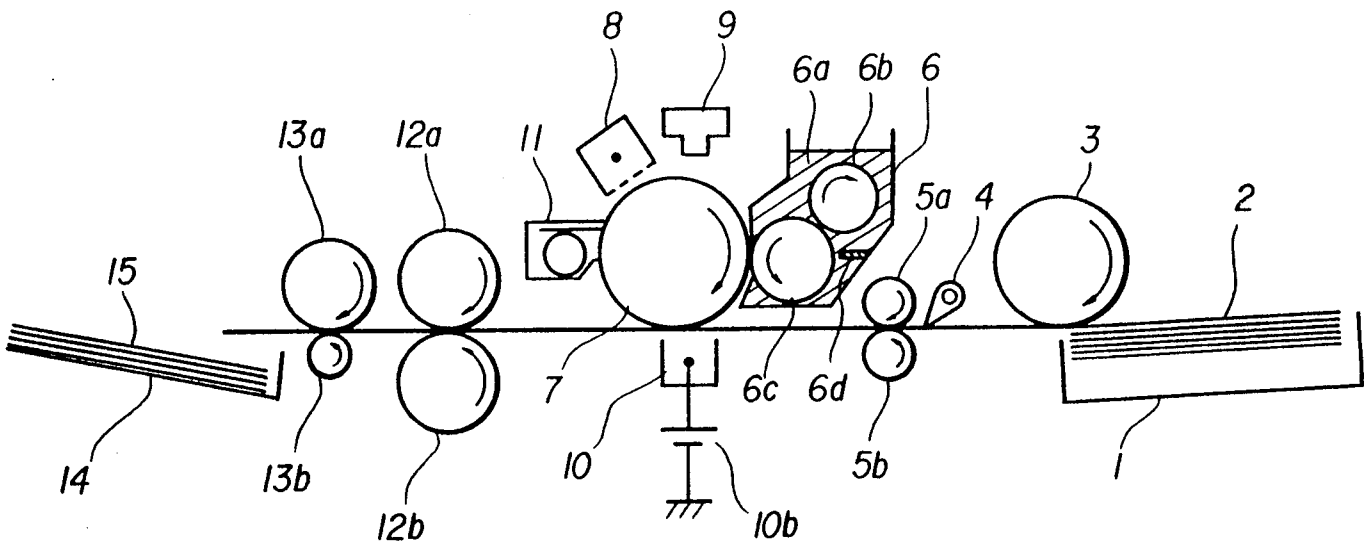
FIG. 2 is a schematic representation of an electrophotographic printer to which the transfer assembly according to the present invention is applicable.
Figure 3:
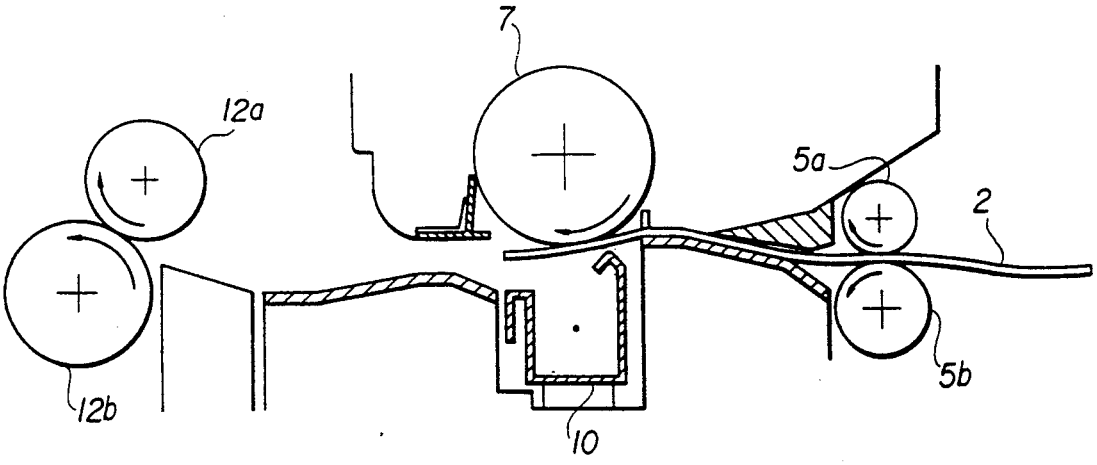
FIG.3 PRIOR ART
FIG. 3 is a schematic representation of a transfer assembly of the conventional electrophotographic printer.
Figure 4:
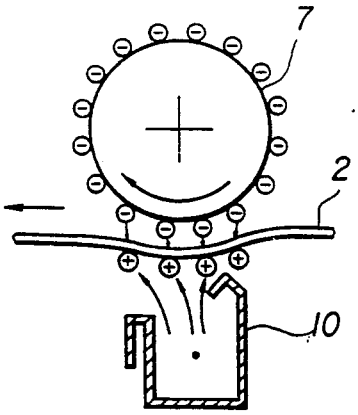
FIG. 4 is a view for explanation of a transfer operation.

FIG. 2 is a schematic representation of an electrophotographic printer to which the transfer assembly according to the present invention is applicable. Referring to the FIG., a hopping roller 3 is rotated by a motor, not shown, to take out a recording medium 2 from a recording medium cassette 1 and to transfer the recording medium 2 until it runs against a pressure roller 5*a* and a feed roller 5*b* after detection by a paper feed sensor 4. The paper feed sensor 4 is provided with a photosensor, not shown, on a rotary axis of a detection lever and is operative to detect the presence/absence of the recording medium by means of rotation of the axis. The pressure roller 5*a*, the feed roller 5*b*, photoconductor drum 7, a heating roller 12*a*, a back-up roller 12*b*, and delivery rollers 13*a* and 13*b* are simultaneously rotated by a motor, not shown.

A photoconductive surface of the photoconductor drum 7 is cleaned by a cleaner 11 and is charged with the negative electricity (−) over the whole by a charger 8. A light emitting diode array or an exposure 9 is selectively operated to illuminate the photoconductive surface of the photoconductor drum 7, so that an electrostatic latent image can be obtained corresponding to image data on the photoconductive surface.

A developing unit 6 provides electrostatic adhesion of a toner to the electrostatic latent image to form a toner image. The toner image is transferred to the recording medium 2 by means of attraction of electrostatic force, since the back surface of the recording medium 2 is charged with the positive electricity (+) by a corona discharge in a transfer unit 10. The toner image transferred to the recording medium 2 is heated and fused between the heating roller 12*a* and a back-up roller 12*b*. The recording medium 2 after fixing is delivered by the delivery rollers 13*a* and 13*b* to a recording medium tray 14.

Figure 1:
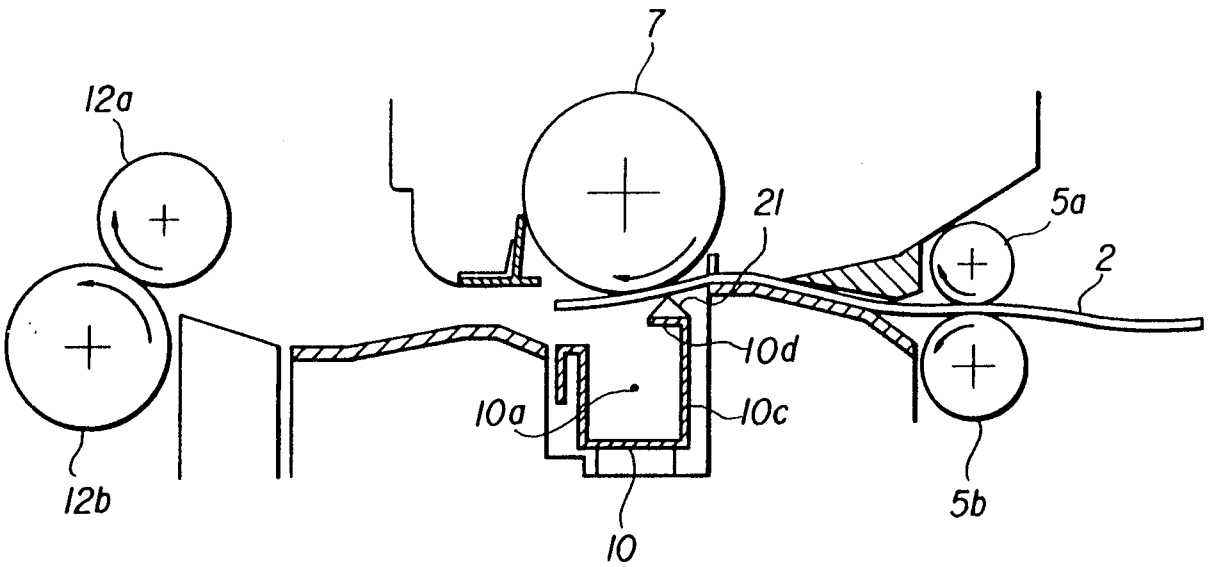
FIG. 1 is a schematic representation of a transfer assembly of an electrophotographic printer according to an illustrative embodiment of the present invention.

FIG. 1 is a schematic representation of a transfer assembly of an electrophotographic printer according to the illustrative embodiment of the present invention. In the figure, a transfer unit 10, which is made of metal, is disposed against a photoconductor drum 7, and is grounded to a frameo of a power supply unit, not shown. The transfer unit 10 is so arranged that an internal wire 10*a* for transfer is surrounded with a shield plate 10*c*, and a guide member 10*d* is formed at such a position that it contacts the recording medium 2 above the shield plate 10*c* so that the recording medium 2 can move smoothly between the transfer unit 10 and the photoconductor drum 7.

A conductive material 21, which has specific electric resistance of $10^5$–$10^{12}$ Ω.cm, is disposed on the guide member 10*d*. The conductive material 21 is so disposed that when the recording medium 2, which has been transferred through the pressure roller 5*a* and the feed roller 5*b*, reaches the transfer unit 10, the recording medium 2 touches first the conductive material 21.

The recording medium 2 fed from the recording medium cassette 1 is transmitted by a pressure roller 5*a* and a feed roller 5*b*, and reaches the photoconductor drum 7. At that time, the recording medium 2 itself has been charged with the positive electricity (+), and thus upon contact with the conductive material 21 provided on the upper portion of the transfer unit 10 a flow of the electric charge is initiated therethrough. However, since the conductive material 21 has specific electric resistance of $10^5$–$10^{12}$Ω. cm. the flow of the electricity is buffered, thereby preventing disturbance of transfer efficiency. Thereafter, the electric charge flows to the power supply unit frame ground in the electrophotographic printer, and then is grounded via a frame ground line. Further, since there is no accumulation of electric charge on the conductive material 21, there occurs no accumulation of toner.

An image is formed on the surface of the photoconductor drum 7 with toner charged with negative electricity (−). When the recording medium 2 arrives at the photoconductor drum 7, the transfer unit 10 produces positive electric charge (+) and transfers the image on the surface of the photoconductor drum 7 to the surface of the recording medium 2. The recording medium 2, to which the toner image is transferred, is heated when passing through a heating roller 12*a* and a back-up roller 12*b*, so that the toner is fused on the surface of recording medium 2.

In the illustrative embodiment stated above, although there is provided the conductive material on the guide member of the transfer unit, it may be considered within the scope of the invention to put there on a sheet or coating consisting of the conductive material.

While the present invention has been described with reference to the particular illustrative embodiment, it is not to be restricted by the embodiment but only by the appended claims. It is to be appreciated that those skilled in the art can change or modify the embodiment without departing from the scope and spirit of the present invention.

What is claimed is:

1. A transfer assembly of an electrophotographic printer comprising:

a photoconductor drum;

charger means disposed against said photoconductor drum for charging a surface of said photoconductor drum;

exposure means for exposing said charged photoconductor drum to form an electrostatic latent image thereon;

developing means disposed against said photoconductor drum for providing adhesion of a toner to the electrostatic latent image to form a toner image on said photoconductor drum;

transfer means disposed adjacent to said photoconductor drum for transferring the toner image to a recording medium; and fuser means for fixing the transferred toner image on the recording medium;

wherein a part of said transfer means, which first touches the recording medium to which the toner image is to be transferred, is provided with a conductive material for providing a gradual discharge of electric charge from the recording medium; and wherein said transfer means comprises:

an internal wire for effecting the transfer of said toner;

a shield plate surrounding said internal wire; and a guide member disposed so that it contacts said recording medium above said shield plate to cause said recording medium to move smoothly between said transfer means and said photoconductor drum.

2. A transfer assembly according to claim 1, wherein said conductive material has a specific electrical resistance in the range of $10^5$–$10^{12}$ Ω. cm.

3. A transfer assembly according to claim 1, wherein said conductive material has a specific electrical resistance in the range of $10^5$–$10^{12}$ Ω. cm, and is disposed on said guide member.

4. A transfer assembly according to claim 3, wherein said conductive material is disposed so that when said recording medium, after transport between a pressure roller and a feed roller, reaches said transfer means, the recording medium first touches said conductive material.

5. A transfer assembly of an electrophotographic printer comprising:

a photoconductor drum;

charger means disposed against said photoconductor drum for charging a surface of said photoconductor drum;

exposure means for exposing said charged photoconductor drum to form an electrostatic latent image thereon;

developing means disposed against said photoconductor drum for providing adhesion of a toner to the electrostatic latent image to form a toner image on said photoconductor drum;

transfer means disposed adjacent to said photoconductor drum for transferring the toner image to a recording medium; and fuser means for fixing the transferred toner image on the recording medium;

wherein a part of said transfer means, which first touches the recording medium to which the toner image is to be transferred, is provided with a conductive material for providing a gradual discharge of electric charge from the recording medium; and wherein the conductive material is formed on said transfer means as a wedge shaped member.

* * * * *